US006333604B1

(12) United States Patent
Robb

(10) Patent No.: US 6,333,604 B1
(45) Date of Patent: Dec. 25, 2001

(54) INTEGRATED IGNITION CIRCUIT AND METHOD

(75) Inventor: Stephen P. Robb, Tempe, AZ (US)

(73) Assignee: Semiconductor Components Industries LLC, Phoenix, AZ (US)

( * ) Notice: Subject to any disclaimer, the term of this patent is extended or adjusted under 35 U.S.C. 154(b) by 0 days.

(21) Appl. No.: 09/669,451

(22) Filed: Sep. 25, 2000

(51) Int. Cl.[7] ..... H05B 37/02

(52) U.S. Cl. ..... 315/209 R; 315/209 T; 307/10.6

(58) Field of Search ..... 315/209 R, 224, 315/200 R, 226, 209 T, 291, 307, 308, 56, 57, 58, 59; 307/10.6, 10.1

(56) References Cited

U.S. PATENT DOCUMENTS 5,664,550 * 9/1997 Ito et al. ..... 123/630
5,970,964 * 10/1999 Furuhata et al. ..... 315/209 T
6,018,202 * 1/2000 Meinders et al. ..... 307/10.6
6,100,728 * 8/2000 Shreve et al. ..... 327/110

* cited by examiner

*Primary Examiner*—Don Wong
*Assistant Examiner*—Thuy Vinh Tran

(57) ABSTRACT

An integrated circuit (10) for driving an ignition coil (14) has a first transistor (30) providing a coil current ($I_{COIL}$) at a first lead (22) of the integrated circuit. A second transistor (32) has a collector coupled to the first lead and an emitter coupled to a gate electrode of the first transistor. A gate electrode of the second transistor is coupled to a second lead (23) of the integrated circuit for receiving a control signal ($V_{ENABLE}$).

19 Claims, 5 Drawing Sheets

INTEGRATED IGNITION CIRCUIT AND METHOD

FIELD OF THE INVENTION

The present invention relates in general to semiconductor devices and, more particularly, to integrated circuits for driving the ignition coils of motor vehicles.

BACKGROUND OF THE INVENTION

Motor vehicles currently use semiconductor devices to perform a wide variety of functions. Engine control circuits use microprocessors to monitor the engine's state and control its operation. Information collected from various sensors in the engine is collectively analyzed and processed to produce timing and control signals for operating engine subsystems. One such subsystem includes an ignition circuit that receives timing signals to control a power switching transistor that supplies current to charge an ignition coil. When the power transistor is turned off, the coil voltage rises to a level sufficient to fire a spark plug, which discharges the coil.

A problem with ignition circuits occurs if the spark plug is removed or fouled so that no spark is generated. Since there is no spark to discharge the coil, the coil voltage can rise to an excessive level, creating an overvoltage condition that causes the coil energy to be dissipated in the power transistor. The dissipation can stress or damage the power transistor and degrade the reliability of the ignition circuit. Previous ignition circuits include internal limiting circuits to limit the voltage and power dissipation while shutting down the ignition circuit. However, the limiting circuits are activated automatically with timing networks, and therefore operate only at specific times in an ignition cycle. If a fault such as an excessive coil temperature occurs at a different time, damage could still result.

Hence, there is a need for an ignition circuit which provides a shut down method that can be activated whenever a fault condition is detected in order to reduce damage and improve the reliability of the ignition circuit.

DETAIL DESCRIPTION OF THE DRAWINGS

In the figures, elements having the same reference numbers have similar functionality.

Figure 1:
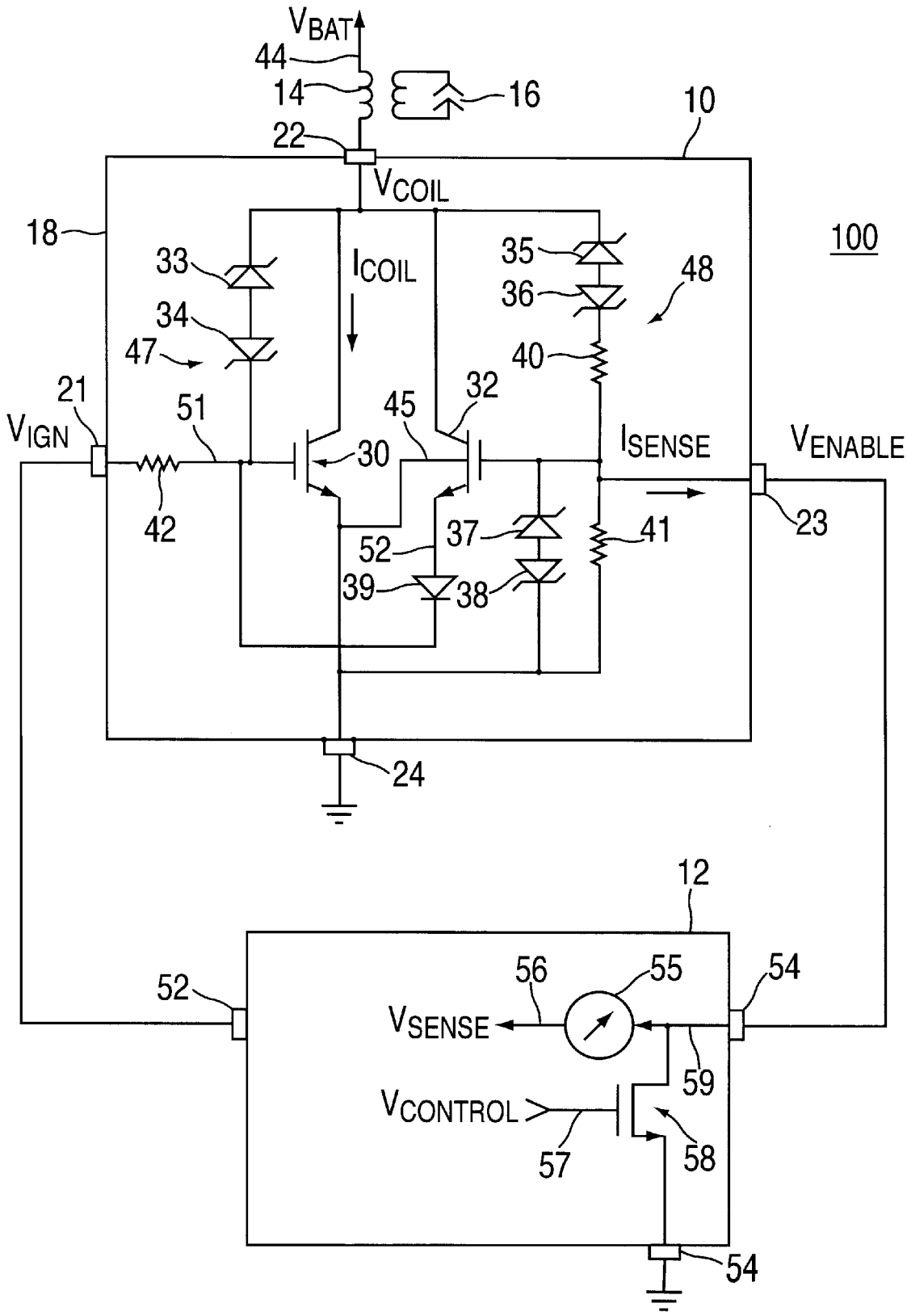
FIG. 1 is a schematic diagram of a spark plug ignition system.

FIG. 1 is a spark plug ignition system 100 for an automobile or other motor vehicle, including an ignition coil 14, a spark plug 16, an ignition circuit 10, and an engine control circuit 12.

Ignition coil 14 operates as a 1:100 step up transformer whose primary winding is coupled between a lead 22 of ignition circuit 10 and a battery terminal 44 operating at a battery voltage $V_{BAT}$=12.0 volts. A secondary winding is coupled across spark plug 16 as shown for generating a secondary voltage sufficient to induce a spark.

Engine control circuit 12 comprises a microprocessor and associated circuitry for monitoring and controlling the operation of an engine (not shown). Engine control circuit 12 monitors performance by collecting and processing information from a variety of sensors. Built-in software routines analyze the collective information and route the appropriate control and timing signals to engine devices.

Engine control circuit 12 generates a digital ignition signal $V_{IGN}$ at intervals depending on factors such as fuel flow or engine temperature and speed, to control when spark plug 16 fires. A logic high of five volts sets the dwell time, i.e., the time to charge coil 14. A low logic level sets the time for firing spark plug 16. If a fault condition such as an overvoltage or overcurrent condition is detected, engine control circuit 12 generates a digital control signal $V_{CONTROL}$ to prevent damage by initiating a shutdown of ignition circuit 10. Engine control circuit includes a current sensor 55 and a transistor 58.

Current sensor 55 has an input 59 coupled to a lead 54 of engine control circuit 12 for receiving a sense current $I_{SENSE}$ flowing from lead 23 of ignition circuit 10. Current sensor includes a comparator for comparing $I_{SENSE}$ with a reference current to produce a digital sense signal $V_{SENSE}$ which is analyzed and processed along with other sensor information. $V_{SENSE}$ typically is a factor in determining whether to generate control signal $V_{CONTROL}$ to initiate a shutdown of ignition circuit 10.

Transistor 58 has a control electrode coupled to an internal node 57 for receiving control signal $V_{CONTROL}$. Transistor 58 operates as a switch whose open drain drives an external lead 54 of engine control circuit 12 to produce an enabling signal $V_{ENABLE}$, which is coupled to lead 23 of ignition circuit 10.

Ignition circuit 10 includes a power semiconductor package 18 for securing external leads 21–24. Package 18 houses a semiconductor die on which are formed a power insulated gate bipolar transistor (IGBT) 30, a clamping circuit 47 and a soft shutdown circuit 48.

IGBT 30 has a conduction path running be tween an emitter coupled to lead 24 and a collector coupled to lead 22. An insulated gate is coupled to a node 51 for receiving ignition signal $V_{IGN}$ to turn on IGBT 30 to supply a coil current $I_{COIL}$=10.0 amperes to lead 22 for charging coil 14. Depending on the application, the peak value of coil current $I_{COIL}$ typically ranges from five to fifteen amperes. Because IGBT 30 has an insulated gate, IGBT 30 operates with a gate capacitance of about one thousand picofarads and there is no direct current (DC) path into the gate. IGBT 30 is formed in a p-well (not shown) biased at ground potential to provide a gate-emitter conduction threshold of about $_{1.5}$ volts. IGBT 30 has a collector breakdown voltage of about six hundred volts.

Resistor 42 is coupled from lead 21 to the gate of IGBT 30 to allow the potential of node 51 to fluctuate under various operating condition such as clamping, soft shutdown and the like. Resistor 42 has a resistance of one kilohm, with a range of about one hundred fifty ohms to one kilohm.

Clamping circuit 47 typically operates when coil 14 has an open secondary condition to prevent a breakdown of IGBT 30. An open secondary condition occurs when spark plug 16 is fouled or has been removed so no spark is generated. Clamping circuit 47 includes diodes 33–34 and resistor 42. Diodes 33–34 operate as regulating devices which are selected to limit a coil voltage $V_{COIL}$ on lead 22 to a first defined value which is less than the breakdown voltage of IGBT 30. In one embodiment, diode 33 comprises an avalanche diode which avalanches or breaks down when $V_{COIL}$ reaches about four hundred volts to prevent breakdown damage to IGBT 30. In an alternative embodiment, diode 33 comprises a serially coupled string of diodes which individually avalanche at a lower voltage but collectively avalanche when $V_{COIL}$ reaches about four hundred volts. Diode 34 operates in a forward biased mode to reduce the temperature variation of $V_{COIL}$ when diode 33 avalanches.

Soft shutdown circuit 48 is activated when a fault condition is detected by setting control signal $V_{CONTROL}$ to a low logic level, i.e., ground potential to put transistor 58 in a high impedance state. Soft shutdown circuit 48 allows coil 14 to be discharged while reducing the power dissipated by ignition circuit 10. Soft shutdown circuit includes diodes 35–36 and 39, resistors 40–41 and IGBT 32. Diodes 35–36 operate as regulating devices which are selected to limit coil voltage $V_{COIL}$ to a second defined value which is lower than the first defined value. Diode 35 preferably avalanches or breaks down at a voltage less than fifty volts to minimize power dissipation. In one embodiment, diode 35 avalanches when $V_{COIL}$ reaches about thirty volts. Diode 35 may comprise a string of lower voltage breakdown diodes which are serially coupled to collectively avalanche when $V_{COIL}$ reaches thirty volts. Diode 36 is forward biased to reduce the temperature variation of the avalanche voltage.

IGBT 32 has an emitter coupled to a node 52 and a collector coupled to lead 22. An insulated gate is coupled to lead 23 for receiving enabling signal $V_{ENABLE}$ from engine control circuit 12 to control the emitter-collector conduction of IGBT 32. IGBT 32 is selected to provide approximately fifty milliamperes of current flow, and is therefore substantially smaller in size than IGBT 30. IGBT 32 typically is formed in a p-well (45) operating at ground potential as IGBT 30 to reduce the gate-emitter conduction threshold of IGBT 32 to 1.5 volts to increase the drive on node 51. IGBT 32 has a collector breakdown voltage of about six hundred volts.

IGBT 32 drives the gate of IGBT 30 through diode 39 to provide isolation when the potential of node 51 is more positive than the potential of node 52. Diode 39 typically is formed from polysilicon.

Resistors 40–41 function as a voltage divider to set the conduction threshold of IGBT 32. Resistor 40 has a value of one hundred fifty kilohms and resistor 41 has a value of twenty kilohms. Resistor 40 provides a current path for a sense current $I_{SENSE}$ which flows from lead 22 through diodes 35–36 to lead 23. Soft shutdown circuit 48 thereby operates as a monitoring circuit that monitors or senses $V_{COIL}$ and provides a representative sense current $I_{SENSE}$ at lead 23 when $V_{COIL}$ exceeds a limit value of thirty volts, i.e., the breakdown voltage of diode 35.

Diodes 37–38 are selected to avalanche at about seven volts to limit the swing of lead 23 and to provide protection from electrostatic discharge. Diodes 37–38 thereby protect transistor 58 from breaking down when coil voltage $V_{COIL}$ reaches a high value, such as when clamping circuit 47 is active.

Figure 2:
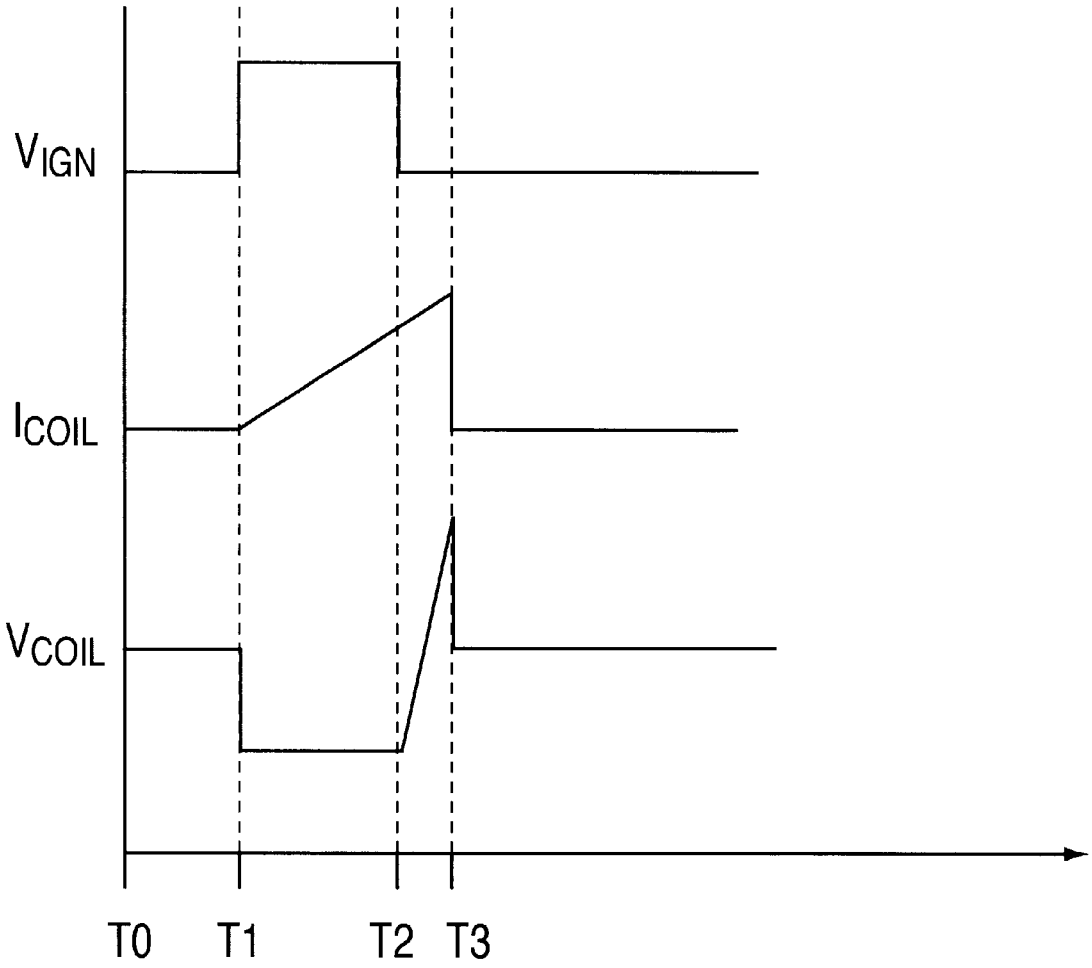
FIG. 2 shows a timing diagram of the spark plug ignition system under a sparking condition.

The operation of ignition circuit 10 can be seen by referring to FIG. 2, showing a timing diagram of spark plug ignition system 100 under a typical sparking condition with no fault condition detected. Control signal $V_{CONTROL}$ is high, i.e., 5.0 volts, which causes transistor 58 to pull lead 23 to ground potential, turning off IGBT 32 and effectively disabling soft shutdown circuit 48.

Initially, at time T0=0.0 seconds, ignition signal $V_{IGN}$ is low and IGBT 30 is turned off. Coil current $I_{COIL}$=0.0 amperes and coil voltage $V_{COIL}=V_{BAT}$=12.0 volts.

At time T1=1.0 milliseconds, ignition signal $V_{IGN}$ is set high, which turns on IGBT 30 to pull coil voltage $V_{COIL}$ to ground potential. Coil current $I_{COIL}$ flows through the primary of coil 14 and through IGBT 30 with an increasing magnitude to charge coil 14 as shown.

At time T2=4.0 milliseconds, as coil current $I_{COIL}$ is reaching a magnitude of about ten amperes, ignition signal $V_{IGN}$ goes low to turn off IGBT 30 and reduce $I_{COIL}$ to zero. Coil voltage $V_{COIL}$ begins to increase, which increases the potential across spark plug 16 in accordance with the 1:100 winding ratio of coil 14.

At time T3=4.15 milliseconds, as coil voltage $V_{COIL}$ reaches about two hundred fifty volts, a spark is induced in spark plug 16. The spark current effectively discharges coil 14, which sets coil voltage $V_{COIL}=V_{BAT}$=12.0 volts to complete the cycle.

Figure 3:
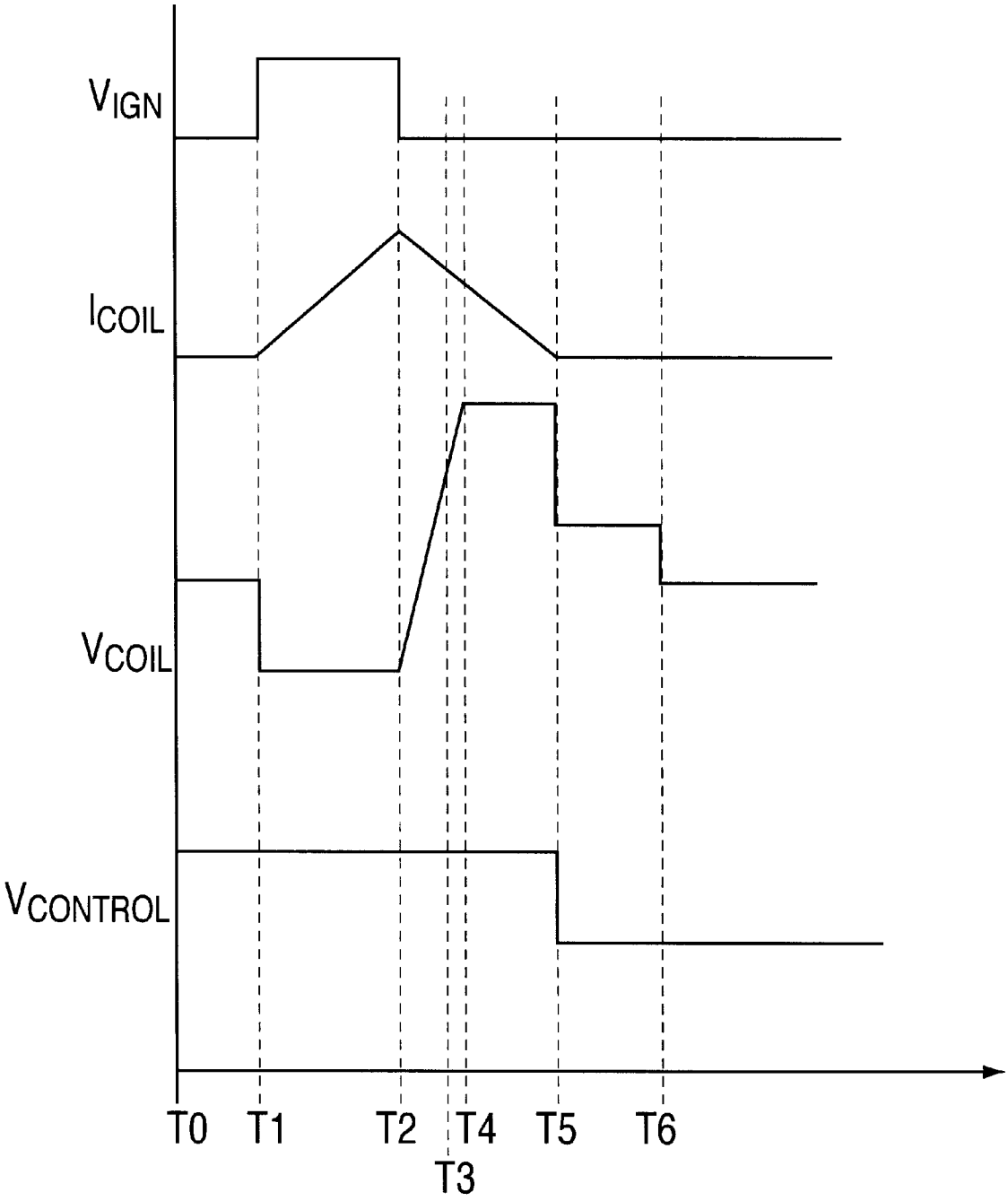
FIG. 3 shows a timing diagram of the spark plug ignition system under an open secondary condition.

FIG. 3 shows a timing diagram of spark plug ignition system 100 under an overvoltage or open secondary condition in which a spark is not generated. From time T0 to time T2, the operation is similar to the above description.

However, at time T3=4.15 milliseconds, $V_{COIL}$ reaches two hundred fifty volts but no spark occurs to discharge coil 14. Consequently, at time T4=4.25 milliseconds, $V_{COIL}$ reaches four hundred volts and diode 33 avalanches, turning on IGBT 30 to supply coil current $I_{COIL}$ at an initial level of about ten amperes to maintain $V_{COIL}$ at four hundred volts. Such an overvoltage condition momentarily subjects IGBT 30 to about four thousand watts of power dissipation and a substantially elevated temperature. As a feature of the present invention, while coil voltage $V_{COIL}$ is maintained at four hundred volts, sense current $I_{SENSE}$ =2.$^5$ milliamperes flows to lead 23. $I_{SENSE}$ is indicative of the value of $V_{COIL}$ , and is therefore used to detect overvoltage conditions. $I_{SENSE}$ is shunted to ground through transistor 58 when control signal $V_{CONTROL}$, is high.

At time T5=4.5 milliseconds, engine control circuit 12 samples $I_{SENSE}$ by setting control signal $V_{CONTROL}$ low to turn off transistor 58. $I_{SENSE}$ is routed through current sensor 55 for converting to sense signal $V_{SENSE}$ and further processing in combination with other engine sensor signals. In response to the detected overvoltage condition, soft shutdown circuit 48 is activated, turning on IGBT 30 and IGBT 32 to reduce coil voltage $V_{COIL}$ to a level of about thirty volts. Hence, the peak power dissipated in IGBT 30 is reduced to less than three hundred watts. Note that $I_{COIL}$ decays at a slower rate due to the lower voltage across coil 14.

At time T6, $I_{COIL}$ decays to zero and $V_{COIL}=V_{BAT}$=12.0 volts to end the cycle.

Figure 4:
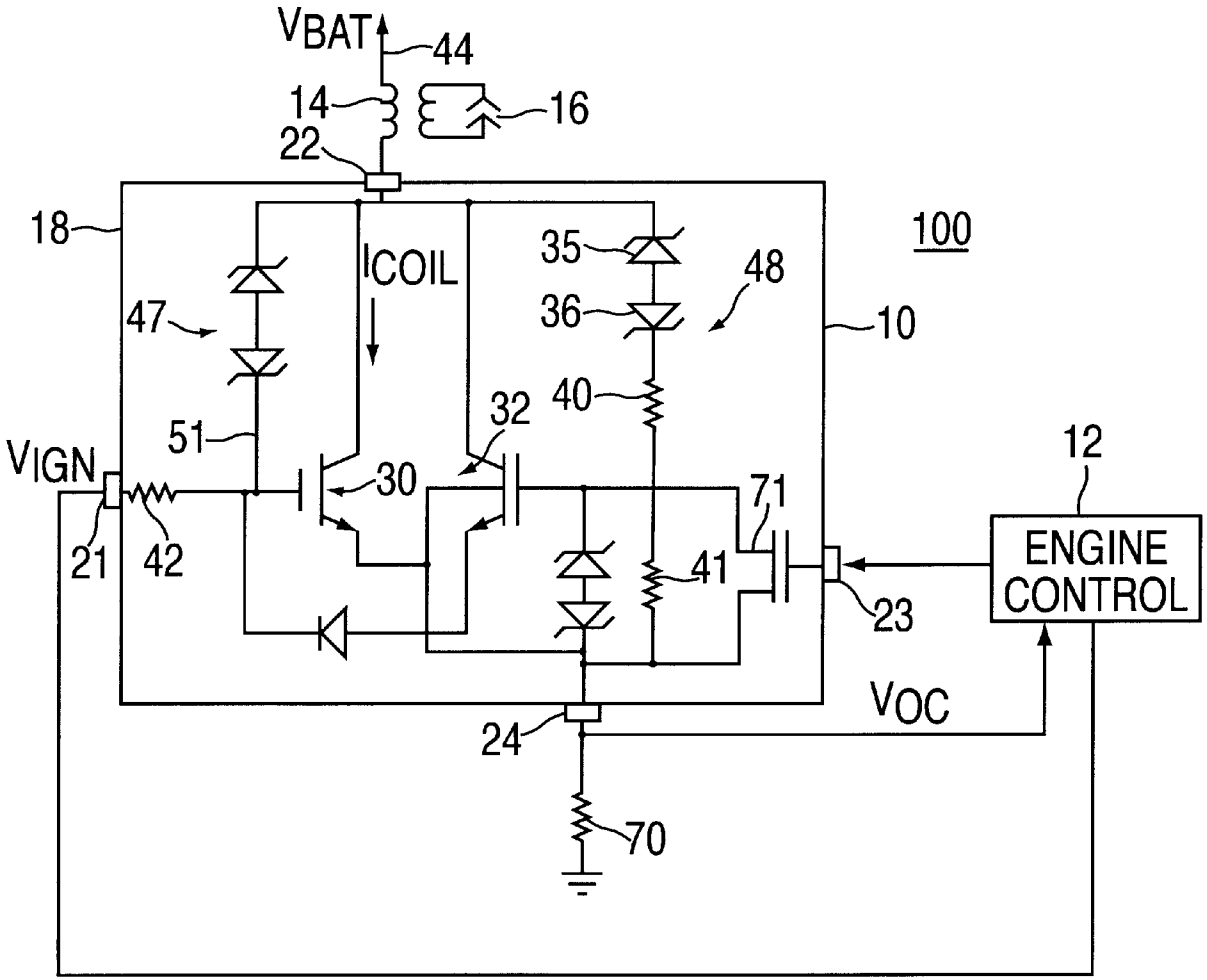
FIG. 4 shows a schematic diagram of a spark plug ignition system in an alternate embodiment.

FIG. 4 shows ignition system 100 configured to detect an overcurrent condition, including integrated ignition circuit 10 in an alternate embodiment. Integrated ignition circuit 10 includes a transistor 71 whose gate is coupled to lead 23 to receive enabling signal $V_{ENABLE}$ for activating soft turnoff circuit 48 as previously described. Lead 24 is coupled to ground through a resistor 70 whose resistance is 0.1 ohms. Hence, during a normal cycle when coil current $I_{COIL}$ ranges from zero to about ten amperes, a sense voltage $V_{OC}$ developed across resistor 70 that varies between zero and 1.0 volts. If coil 14 is partially shorted, $I_{COIL}$ and $V_{OC}$ increase substantially, causing excessive power to be dissipated in integrated ignition circuit 10.

A skilled artisan would understand that the embodiment shown in FIG. 4 may be modified to provide protection during an overvoltage as well as overcurrent condition. For example, the gate electrode of IGBT 32 may be coupled to an external lead of package 18 to provide sense current $I_{SENSE}$ in a fashion similar to that of FIG. 1.

Figure 5:
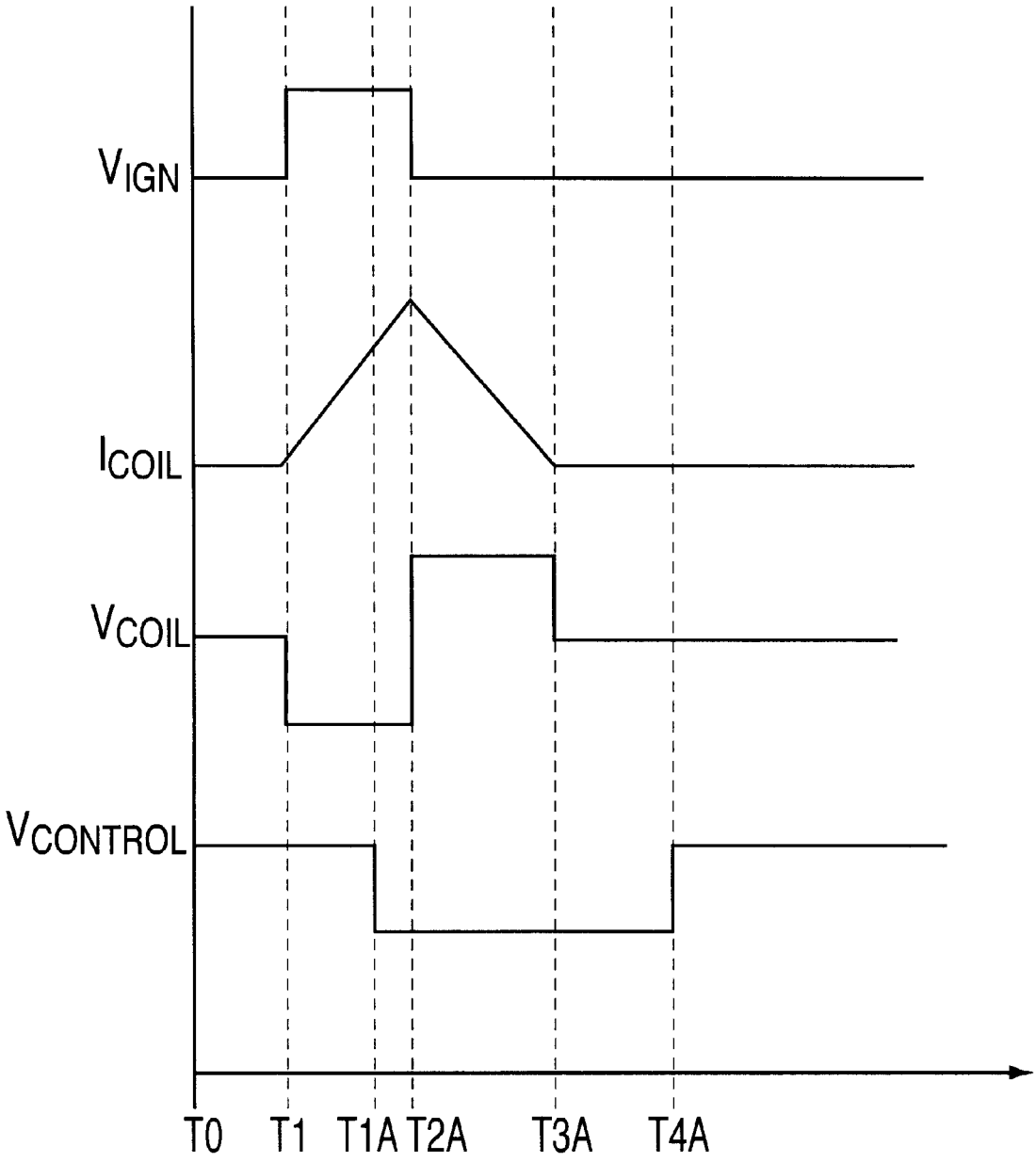
FIG. 5 shows a timing diagram of the alternate embodiment of the spark plug ignition system under an overcurrent condition.

The operation of ignition system 100 during an overcurrent condition can be seen in the timing diagram of FIG. 5. An overcurrent condition typically occurs because one or more primary windings of coil 14 are shorted, which reduces the inductance.

At initial time T0=0.0 seconds, ignition signal $V_{IGN}$ is low, $I_{COIL}$, is zero amperes, and $V_{COIL}=V_{BAT}=12.0$ volts as previously described. Control signal $V_{CONTROL}$ is set high to turn on transistor 71 and disable soft turnoff circuit 48.

At time T1=1.0 milliseconds, ignition signal $V_{IGN}$ goes high, turning on IGBT 30 to supply coil current $I_{COIL}$ and to pull $V_{COIL}$ to ground potential as previously described.

At time T1A=3 .0 milliseconds, $I_{COIL}$ reaches a value of 8.0 amperes, but in a normal cycle would reach only 5.0 amperes. Hence, $V_{OC}$=0.8 volts, where its normal value would be 0.5 volts. Engine control circuit 12 samples sense voltage $V_{OC}$ and detects the overcurrent condition and, in response, sets control signal $V_{CONTROL}$ low to turn off transistor 71 and activate soft turnoff circuit 48.

At time T2A=4.0 milliseconds, ignition signal $V_{IGN}$ is taken low, turning off IGBT 30 and allowing $V_{COIL}$ to rise. Soft turnoff circuit 48 clamps and regulates $V_{COIL}$ at a level of thirty volts, thereby preventing a spark and reducing dissipation while $I_{COIL}$ decays.

At time T3A=6.0 milliseconds, coil current $I_{COIL}$ decays to zero and $V_{COIL}=V_{BAT}=12.0$ volts. At time T4A=7.0 milliseconds, $V_{CONTROL}$ is returned to high to end the cycle.

Note that the time points indicated in the foregoing description are exemplary and represent typical times for a particular application. Times such as the dwell and other times may vary with different applications and/or operating conditions such as temperature.

By now it should be appreciated that the present invention provides an integrated ignition circuit and method of driving a coil. A first transistor supplies a current at a first lead of the ignition circuit to charge the coil. A second transistor has a conduction path coupled between the first lead and the gate electrode of the first transistor and a gate coupled to a second lead of the integrated ignition circuit for receiving an enabling signal when the voltage on the first lead exceeds a defined voltage of, for example, thirty volts. The enabling signal activates the first transistor to discharge the coil at the defined voltage, which reduces the power dissipated in the integrated ignition circuit and improves reliability. Because power dissipation is reduced, the first transistor can be formed to occupy a smaller die area, thereby reducing the manufacturing cost.

What is claimed is:

1. An integrated ignition circuit, comprising:

a first transistor coupled to a first lead of the integrated ignition circuit for supplying a coil current in response to an ignition signal; and a second transistor having an emitter coupled to a gate electrode of the first transistor, and a gate electrode coupled to a second lead of the integrated ignition circuit for receiving a control signal, wherein the second transistor is formed in a p-well biased to ground potential.

2. The integrated ignition circuit of claim 1, wherein the first and second transistors comprise insulated gate bipolar transistors.

3. The integrated ignition circuit of claim 1, further comprising a clamping circuit coupled between the first lead and the gate electrode of the first transistor for limiting a voltage on the first lead to a limit value.

4. The integrated ignition circuit of claim 1, further comprising a monitoring circuit coupled to the first lead for sensing a coil voltage to develop a representative sense current at the second lead when the coil voltage is greater than a limit value.

5. The integrated ignition circuit of claim 4, wherein the monitoring circuit includes a diode coupled between the first and second leads for blocking the sense current when the coil voltage is less than the limit value.

6. The integrated ignition circuit of claim 1, further comprising a diode having an anode coupled to the emitter of the second transistor and a cathode coupled to the gate electrode of the first transistor.

7. The integrated ignition circuit of claim 1, further comprising a third transistor having a conduction electrode coupled to the gate electrode of the second transistor and a gate electrode coupled to the second lead for receiving the control signal.

8. The integrated ignition circuit of claim 1, further comprising a package for securing the first and second leads of the integrated ignition circuit.

9. An integrated circuit, comprising:

a first transistor having a conduction path coupled to a first lead of the integrated circuit and a gate for controlling a coil current;

a second transistor formed in a p-well of the integrated circuit and having a collector coupled to the first lead, an emitter coupled to the gate of the first transistor, and a gate coupled to a second lead of the integrated circuit for receiving an enabling signal; and an integrated circuit package for housing the first and second transistors.

10. The integrated circuit of claim 9, wherein the first and second transistors are insulated gate bipolar transistors.

11. The integrated circuit of claim 9, further comprising a first diode coupled between the first lead and the gate of the first transistor for avalanching when the first lead reaches a first limit voltage.

12. The integrated circuit of claim 11, further comprising a second diode coupled between the first lead and the gate of the second transistor for avalanching when the first lead reaches a second limit voltage that is less than the first limit voltage.

13. The integrated circuit of claim 9, wherein the gate of the first transistor is coupled to a third lead of the integrated circuit for receiving an ignition signal.

14. The integrated circuit of claim 9, further comprising a diode having a cathode coupled to the gate of the first transistor and an anode coupled to the conduction path of the second transistor.

15. A method of driving a coil, comprising the steps of:

applying a first control signal to a first transistor to produce a charging current through the coil;

developing a sense current indicative of a coil voltage to produce an enabling signal when the coil voltage exceeds a defined level; and activating a second transistor with a second control signal to route the enabling signal to the first transistor for discharging the coil.

16. The method of claim 15, wherein the step of applying a control signal includes the step of applying the control signal to a gate of the first transistor.

17. The method of claim 16, further comprising the step of blocking the sense current when the coil voltage is less than the defined level.

18. The method of claim 15, wherein the step of developing includes the step of avalanching a first diode to produce the sense current.

19. The method of claim 18, wherein the step of avalanching includes the step of avalanching the first diode when the coil voltage is less than fifty volts.

* * * * *